US007701451B1

(12) United States Patent
Daewon et al.

(10) Patent No.: US 7,701,451 B1
(45) Date of Patent: Apr. 20, 2010

(54) BOOST LOOK UP TABLE COMPRESSION SYSTEM AND METHOD

(75) Inventors: Lee Daewon, San Jose, CA (US); Abhay Gupta, San Jose, CA (US)

(73) Assignee: Pixelworks, Inc., Tualatin, OR (US)

( * ) Notice: Subject to any disclaimer, the term of this patent is extended or adjusted under 35 U.S.C. 154(b) by 1268 days.

(21) Appl. No.: 11/192,944

(22) Filed: Jul. 29, 2005

(51) Int. Cl.
*G09G 5/00* (2006.01)

(52) U.S. Cl. ..... 345/204; 345/589; 345/601; 345/602

(58) Field of Classification Search ..... 345/204, 345/589, 601–602
See application file for complete search history.

(56) References Cited

U.S. PATENT DOCUMENTS 6,661,358 B1 * 12/2003 Hashimoto ..... 341/67
6,747,660 B1 * 6/2004 Olano et al. ..... 345/582
2003/0231158 A1 * 12/2003 Someya et al. ..... 345/101
2004/0240755 A1 * 12/2004 Wong et al. ..... 382/293
2005/0088462 A1 * 4/2005 Borel ..... 345/691

* cited by examiner

*Primary Examiner*—Richard Hjerpe
*Assistant Examiner*—Leonid Shapiro
(74) *Attorney, Agent, or Firm*—Marger Johnson & McCollom, P.C.

(57) ABSTRACT

An embodiment may include an apparatus comprising a controller for a display system, a first look up table containing data for the controller to operate the display system, and a second look up table with data that is offset from the first look up table data to preserve memory space in the controller. An embodiment may be a method comprising storing color data in a first look up table, storing color data in at least one offset look up table, the at least one offset look up table using offset values from the first look up table, and controlling a display with the first look up table and the at least one offset look up table.

20 Claims, 7 Drawing Sheets

| | 0 | 16 | 32 | 48 | 64 | 80 | 96 | 112 | 128 | 144 | 160 | 176 | 192 | 208 | 224 | 240 | 255 |
|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 |
| 16 | 30 | 16 | 4 | 0 | 0 | 0 | 0 | 0 | 0 | 0 | 0 | 0 | 0 | 0 | 0 | 0 | 0 |
| 32 | 50 | 39 | 32 | 18 | 8 | 0 | 0 | 0 | 0 | 0 | 0 | 0 | 0 | 0 | 0 | 0 | 0 |
| 48 | 80 | 65 | 50 | 48 | 32 | 28 | 16 | 11 | 6 | 2 | 0 | 0 | 0 | 0 | 0 | 0 | 0 |
| 64 | 120 | 105 | 90 | 78 | 64 | 52 | ***46*** | 40 | 32 | 24 | 16 | 8 | 0 | 0 | 0 | 0 | 0 |
| 80 | 140 | 128 | 116 | 104 | 92 | 80 | 74 | 67 | 60 | 56 | 50 | 44 | 36 | 30 | 24 | 16 | 8 |
| 96 | 160 | 150 | 139 | 128 | 117 | 106 | 96 | 90 | 84 | 76 | 69 | 60 | 48 | 42 | 36 | 30 | 24 |
| 112 | 180 | 170 | 160 | 150 | 140 | 130 | 120 | 112 | 104 | 98 | 90 | 80 | 70 | 64 | 58 | 53 | 48 |
| 128 | 192 | 184 | 176 | 168 | 160 | ***152*** | 144 | 136 | 128 | 122 | 118 | 113 | 108 | 96 | 84 | 74 | 64 |
| 144 | 200 | 192 | 186 | 180 | 174 | 168 | 162 | 156 | 150 | 144 | 140 | 135 | 126 | 116 | 106 | 98 | 92 |
| 160 | 205 | 200 | 195 | 190 | 185 | 180 | 176 | 172 | 168 | 164 | 160 | 156 | 152 | 147 | 142 | 136 | 128 |
| 176 | 209 | 206 | 203 | 200 | 197 | 194 | 191 | 188 | 185 | 182 | 179 | 176 | 174 | 171 | 168 | 164 | 160 |
| 192 | 216 | 214 | 212 | 210 | 208 | 206 | 204 | 202 | 200 | 198 | 196 | 194 | 192 | 190 | 188 | 186 | 184 |
| 208 | 221 | 220 | 219 | 218 | 217 | 216 | 215 | 214 | 213 | 212 | 211 | 210 | 209 | 208 | 208 | 207 | 206 |
| 224 | 240 | 228 | 228 | 227 | 227 | 227 | 226 | 226 | 226 | 225 | 225 | 225 | 224 | 224 | 224 | 224 | 224 |
| 240 | 240 | 242 | 242 | 242 | 242 | 241 | 241 | 241 | 241 | 241 | 240 | 240 | 240 | 240 | 240 | 240 | 240 |
| 255 | 255 | 255 | 255 | 255 | 255 | 255 | 255 | 255 | 255 | 255 | 255 | 255 | 255 | 255 | 255 | 255 | 255 |

FIG. 4

| | 0 | 16 | 32 | 48 | 64 | 80 | 96 | 112 | 128 | 144 | 160 | 176 | 192 | 208 | 224 | 240 | 255 |
|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 |
| 16 | 30 | 16 | 4 | 0 | 0 | 0 | 0 | 0 | 0 | 0 | 0 | 0 | 0 | 0 | 0 | 0 | 0 |
| 32 | 50 | 39 | 32 | 18 | 8 | 0 | 0 | 0 | 0 | 0 | 0 | 0 | 0 | 0 | 0 | 0 | 0 |
| 48 | 80 | 65 | 50 | 48 | 32 | 28 | 16 | 11 | 6 | 2 | 0 | 0 | 0 | 0 | 0 | 0 | 0 |
| 64 | 120 | 105 | 90 | 78 | 64 | 52 | ***68*** | 40 | 32 | 24 | 16 | 8 | 0 | 0 | 0 | 0 | 0 |
| 80 | 140 | 128 | 116 | 104 | 92 | 80 | 74 | 67 | 60 | 56 | 50 | 44 | 36 | 30 | 24 | 16 | 8 |
| 96 | 160 | 150 | 139 | 128 | 117 | 106 | 96 | 90 | 84 | 76 | 69 | 60 | 48 | 42 | 36 | 30 | 24 |
| 112 | 180 | 170 | 160 | 150 | 140 | 130 | 120 | 112 | 104 | 98 | 90 | 80 | 70 | 64 | 58 | 53 | 48 |
| 128 | 192 | 184 | 176 | 168 | 160 | ***145*** | 144 | 136 | 128 | 122 | 118 | 113 | 108 | 96 | 84 | 74 | 64 |
| 144 | 200 | 192 | 186 | 180 | 174 | 168 | 162 | 156 | 150 | 144 | 140 | 135 | 126 | 116 | 106 | 98 | 92 |
| 160 | 205 | 200 | 195 | 190 | 185 | 180 | 176 | 172 | 168 | 164 | 160 | 156 | 152 | 147 | 142 | 136 | 128 |
| 176 | 209 | 206 | 203 | 200 | 197 | 194 | 191 | 188 | 185 | 182 | 179 | 176 | 174 | 171 | 168 | 164 | 160 |
| 192 | 216 | 214 | 212 | 210 | 208 | 206 | 204 | 202 | 200 | 198 | 196 | 194 | 192 | 190 | 188 | 186 | 184 |
| 208 | 221 | 220 | 219 | 218 | 217 | 216 | 215 | 214 | 213 | 212 | 211 | 210 | 209 | 208 | 208 | 207 | 206 |
| 224 | 240 | 228 | 228 | 227 | 227 | 227 | 226 | 226 | 226 | 225 | 225 | 225 | 224 | 224 | 224 | 224 | 224 |
| 240 | 240 | 242 | 242 | 242 | 242 | 241 | 241 | 241 | 241 | 241 | 240 | 240 | 240 | 240 | 240 | 240 | 240 |
| 255 | 255 | 255 | 255 | 255 | 255 | 255 | 255 | 255 | 255 | 255 | 255 | 255 | 255 | 255 | 255 | 255 | 255 |

FIG. 5

| | 0 | 16 | 32 | 48 | 64 | 80 | 96 | 112 | 128 | 144 | 160 | 176 | 192 | 208 | 224 | 240 | 255 |
|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 |
| 16 | 0 | 0 | 0 | 0 | 0 | 0 | 0 | 0 | 0 | 0 | 0 | 0 | 0 | 0 | 0 | 0 | 0 |
| 32 | 0 | 0 | 0 | 0 | 0 | 0 | 0 | 0 | 0 | 0 | 0 | 0 | 0 | 0 | 0 | 0 | 0 |
| 48 | 0 | 0 | 0 | 0 | 0 | 0 | 0 | 0 | 0 | 0 | 0 | 0 | 0 | 0 | 0 | 0 | 0 |
| 64 | 0 | 0 | 0 | 0 | 0 | 0 | *22* | 0 | 0 | 0 | 0 | 0 | 0 | 0 | 0 | 0 | 0 |
| 80 | 0 | 0 | 0 | 0 | 0 | 0 | 0 | 0 | 0 | 0 | 0 | 0 | 0 | 0 | 0 | 0 | 0 |
| 96 | 0 | 0 | 0 | 0 | 0 | 0 | 0 | 0 | 0 | 0 | 0 | 0 | 0 | 0 | 0 | 0 | 0 |
| 112 | 0 | 0 | 0 | 0 | 0 | 0 | 0 | 0 | 0 | 0 | 0 | 0 | 0 | 0 | 0 | 0 | 0 |
| 128 | 0 | 0 | 0 | 0 | 0 | *-7* | 0 | 0 | 0 | 0 | 0 | 0 | 0 | 0 | 0 | 0 | 0 |
| 144 | 0 | 0 | 0 | 0 | 0 | 0 | 0 | 0 | 0 | 0 | 0 | 0 | 0 | 0 | 0 | 0 | 0 |
| 160 | 0 | 0 | 0 | 0 | 0 | 0 | 0 | 0 | 0 | 0 | 0 | 0 | 0 | 0 | 0 | 0 | 0 |
| 176 | 0 | 0 | 0 | 0 | 0 | 0 | 0 | 0 | 0 | 0 | 0 | 0 | 0 | 0 | 0 | 0 | 0 |
| 192 | 0 | 0 | 0 | 0 | 0 | 0 | 0 | 0 | 0 | 0 | 0 | 0 | 0 | 0 | 0 | 0 | 0 |
| 208 | 0 | 0 | 0 | 0 | 0 | 0 | 0 | 0 | 0 | 0 | 0 | 0 | 0 | 0 | 0 | 0 | 0 |
| 224 | 0 | 0 | 0 | 0 | 0 | 0 | 0 | 0 | 0 | 0 | 0 | 0 | 0 | 0 | 0 | 0 | 0 |
| 240 | 0 | 0 | 0 | 0 | 0 | 0 | 0 | 0 | 0 | 0 | 0 | 0 | 0 | 0 | 0 | 0 | 0 |
| 255 | 0 | 0 | 0 | 0 | 0 | 0 | 0 | 0 | 0 | 0 | 0 | 0 | 0 | 0 | 0 | 0 | 0 |

FIG. 6

BOOST LOOK UP TABLE COMPRESSION SYSTEM AND METHOD

BACKGROUND

Display technologies are rapidly evolving. Improvements in integrated circuit manufacturing, higher levels of transistor integration, general display device improvements, interface advances, etc., place considerable demands on video display control circuitry. Liquid crystal display (LCD) manufacturers conventionally use look-up-tables (LUT) to link index numbers to output values and replace runtime computation with simpler lookup operations. For example, LUTs may quickly provide information to compensate for delays caused in changing liquid crystal (LC) modes. Unfortunately, many factors may change and necessitate additional LUTs. Changes in temperature, in each color, in frame frequency, in display size, and in resolution may all require different LUTs and therefore use a considerable amount of memory.

For instance, temperature variations may affect LC driving response time. A typical LCD operating range is 0 to 55 degrees Celsius. Different LUT values can be used to compensate for these variations, for example, different LUT values at 5 degree increments. In the present example, 12 different LUTs spaced at 5 degree intervals will cover a 55 degree temperature range. Other variations may require different LUTs. As examples, LUTs may differ for each red, green, and blue (RGB) color and for different frame frequencies such as 50 Hz, 60 Hz, 75 Hz, etc.

Active matrix LCDs present additional challenges for LUTs use since optical characteristics are determined by various factors including: the LC material, different LC modes, thin film transistor (TFT) requirements, and manufacturing and driving methods. These variations complicate LUT use and increase LUT requirements.

Furthermore, LUTs may be differentiated by color depth. For example, an 8 bit color depth for RGB data equates to 256 levels of gray scale. Therefore an LUT with 8 bit data can implement 256 levels of gray scale. Color may be compensated with expanded color coordinates, dithering and frame rate control (FRC) to allow 8 bit data to perform like 9 bit data.

To properly implement LUTs with the above constraints, that is, 12 temperature variations, 3 independent color components such as RGB, and 4 frame frequencies, requires 144 independent LUTs. Additionally, a typical LUT may comprise many values, for example 256 source grays, 256 compensated grays, and 8 bits.

For these reasons, LCD manufacturers reduce basic LUT dimensions. An example LUT size reduction uses 16 source grays, 16 compensated grays, and is in 8 bit format, resulting in 2048 bits. Even after LUT size reduction, many LUTs are needed. LCD manufacturers may reduce the number of LUTs by optimizing LCD characteristics. Accordingly, a need remains for improve LUT efficiency.

BRIEF DESCRIPTION OF THE DRAWINGS

The foregoing and other objects, features, and advantages will become more readily apparent from the detailed description of invention embodiments that references the following drawings.

FIG. 4 illustrates a LUT that may be used in an embodiment.

FIG. 5 illustrates a second LUT that may be used in an embodiment.

FIG. 6 illustrates an offset LUT that may be used in an embodiment.

DETAILED DESCRIPTION

In the following description, numerous specific details are set forth. However, it is understood that embodiments may be practiced without these specific details. In other instances, well-known circuits, structures, and techniques have not been shown in detail in order to not obscure the understanding of this description. The appearance of the phrase "in one embodiment" in various places in the specification do not necessarily all refer to the same embodiment.

Embodiments may provide more efficient use of memory space or consume fewer transistors by using offset values in a LUT from a reference LUT. An embodiment may include a plurality of LUTs where an LUT can be used as a reference LUT and other LUTs may be offset LUTs, and thus provide more efficient use of silicon or provide for faster loading or shorter start up times for display devices.

Figure 1:
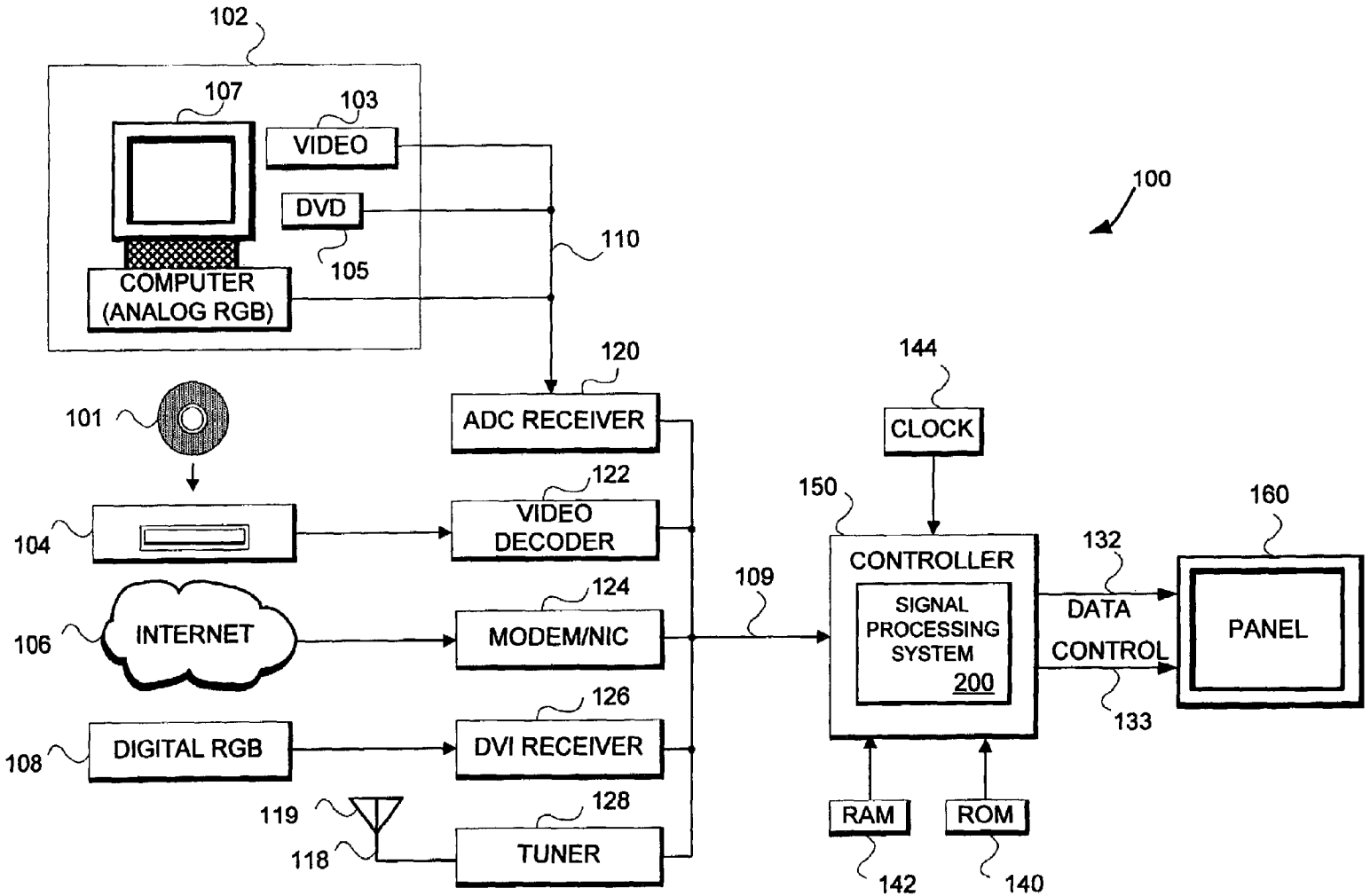
FIG. 1 is a block diagram of a display system.

FIG. 1 is a block diagram of display system 100. Referring to FIG. 1, the system 100 includes a receiver 120 for receiving an analog image data signal 110, e.g., RGB or $YP_BP_R$ signal, from a source 102. The source 102 may be a personal computer 107, a digital video disk player 105, set top box (STB) 103, or any other device capable of generating the analog image data signal 110.

The receiver 120 may be an analog-to-digital converter (ADC) or any other device capable of generating digital video signal 109 from the analog image data 110. The receiver 120 converts the analog image data signal 110 into the digital image data 109 and provides it to a controller 150. A person of reasonable skill in the art knows well the design and operation of the source 102 and the receiver 120.

Likewise, a video receiver or decoder 122 decodes an analog video signal 112 from a video source 104. The video source 104 may be a video camcorder, tape player, digital video disk (DVD) player, or any other device capable of generating the analog video signal 112. The video source 104 may read (or play) external media 101. In an embodiment, a DVD player 104 plays the DVD 101. In another embodiment, a VHS tape player 104 plays a VHS tape 101.

The decoder 122 converts the analog video signal 112 into the digital video signal 109 and provides it to the panel controller 150. The decoder 122 is any device capable of generating digital video signal 109, e.g., in Y/C or CVBS format, from the analog video signal 112. A person of reasonable skill in the art knows well the design and operation of the video source 104 and the video decoder 112.

A modem or network interface card (NIC) 124 receives data 114 from a global computer network 106 such as the Internet. The data 114 may be in any format capable of transmission over the network 106.

In an embodiment, the data 114 is packetized digital data. But the data 114 may also be in an analog form. Likewise, the modem 124 may be a digital or analog modem or any device capable of receiving data 114 from a network 106. The modem 124 provides digital video signal 109 to the panel controller 150. A person of reasonable skill in the art knows well the design and operation of the network 106 and the modem/NIC 124.

A Digital Visual Interface (DVI) or high definition multimedia interface (HDMI) receiver 126 receives digital signals 116 from a digital source 108. In an embodiment, the source 108 provides digital RGB signals 116 to the receiver 126. The receiver 126 provides digital video signal 109 to the panel controller 150. A person of reasonable skill in the art knows well the design and operation of the source 108 and the receiver 126.

A tuner 128 receives a wireless signal 118 transmitted by the antenna 119. The antenna 119 is any device capable of wirelessly transmitting or broadcasting the signal 118 to the tuner 128.

In an embodiment, the antenna 119 transmits a television signal 118 to the television tuner 128. The tuner 128 may be any device capable of receiving a signal 118 transmitted wirelessly by any other device, e.g., the antenna 119, and of generating the digital video signal 109 from the wireless signal 118. The tuner 128 provides the digital video signal 109 to the controller 150. A person of reasonable skill in the art knows well the design and operation of the antenna 119 and the tuner 128.

The digital video signal 109 may be in a variety of formats, including composite or component video. Composite video describes a signal in which luminance, chrominance, and synchronization information are multiplexed in the frequency, time, and amplitude domain for single wire transmission. Component video, on the other hand, describes a system in which a color picture is represented by a number of video signals, each of which carries a component of the total video information. In a component video device, the component video signals are processed separately and, ideally, encoding into a composite video signal occurs only once, prior to transmission. The digital video signal 109 may be a stream of digital numbers describing a continuous analog video waveform in either composite or component form. FIG. 1 describes a variety of devices (and manners) in which the digital video signal 109 may be generated from an analog video signal or other sources. A person of reasonable skill in the art should recognize other devices for generating the digital video signal 109 come within the scope of the present invention.

The controller 150 generates image data 132 and control signals 133 by manipulating the digital video signal 109. The panel controller 150 provides the image data 132 and control signals 133 to a panel device 160. The panel 160 may include a pixelated display that has a fixed pixel structure.

Examples of pixelated displays are active and passive LCD displays, plasma displays (PDP), field emissive displays (FED), electro-luminescent (EL) displays, micro-mirror technology displays, low temperature polysilicon (LTPS) displays, and the like.

The panel 160 may alternatively be a cathode ray tube display or other like technology. A person of reasonable skill in the art should recognize that panel 160 may be a television, monitor, projector, personal digital assistant, and other like applications.

In an embodiment, the controller 150 may scale the digital video signal 109 for display by the panel 160 using a variety of techniques including pixel replication, spatial and temporal interpolation, digital signal filtering and processing, and the like. In another embodiment, the controller 150 may additionally change the resolution of the digital video signal 109, changing the frame rate and/or pixel rate encoded in the digital video signal 109. Scaling, resolution, frame, and/or pixel rate conversion are not central to this invention and are not discussed in further detail.

Read-only (ROM) and random access (RAM) memories 140 and 142, respectively, are coupled to the display system controller 150 and store bitmaps, FIR filter coefficients, and the like. A person of reasonable skill in the art should recognize that the ROM and RAM memories 140 and 142, respectively, may be of any type or size depending on the application, cost, and other system constraints.

A person of reasonable skill in the art should recognize that the ROM and RAM memories 140 and 142, respectively, are optional in the system 100. A person of reasonable skill in the art should recognize that the ROM and RAM memories 140 and 142, respectively, may be external or internal to the controller 150. RAM memory 142 may be a flash type memory device. Clock 144 controls timing associated with various operations of the controller 150.

The controller 150 includes a signal processing system 200 to process signals as is described in association with FIGS. 2-7.

Figure 2:
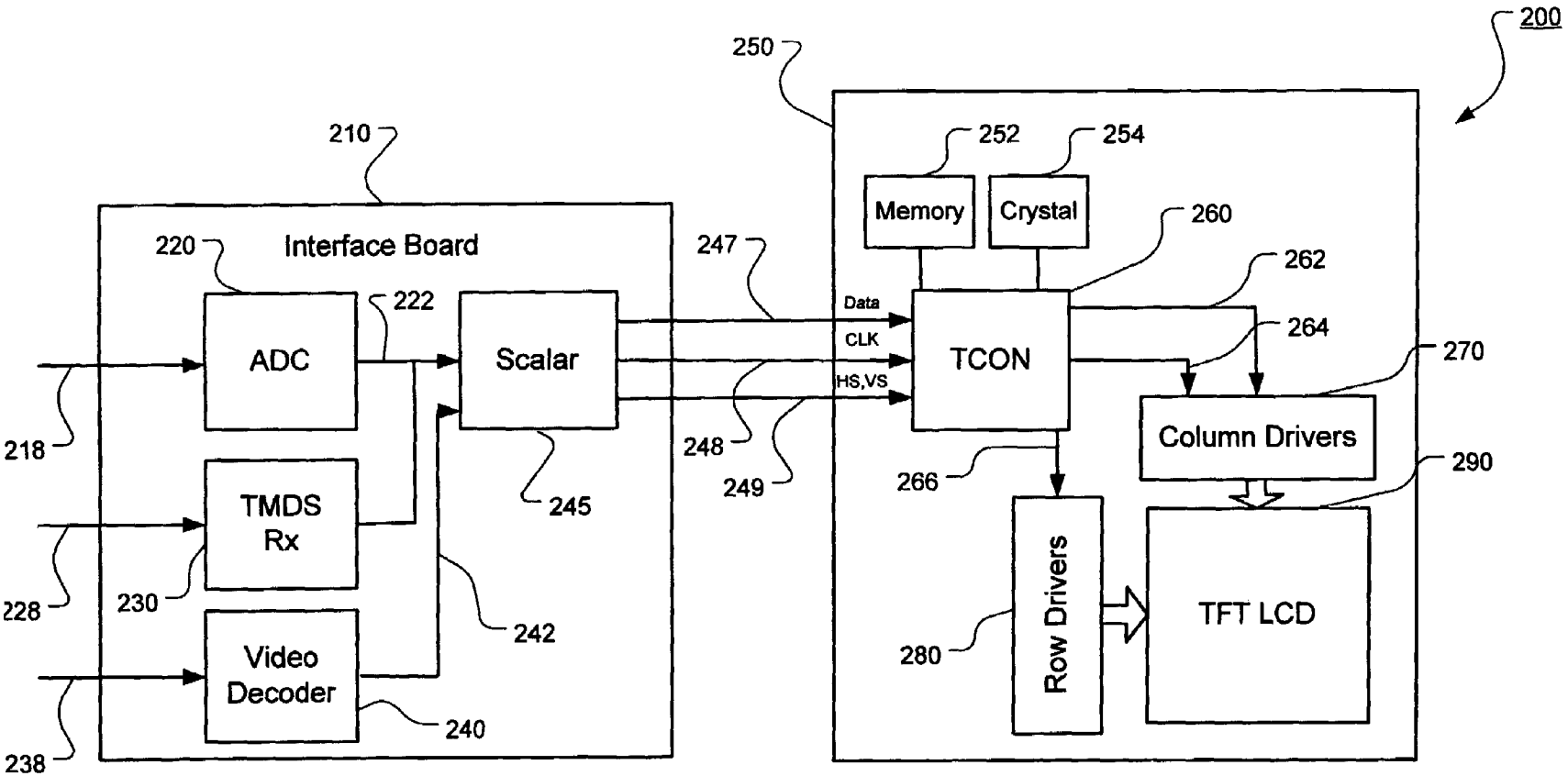
FIG. 2 is a block diagram of an interface board and a display.

FIG. 2 is a block diagram of an embodiment with an interface board 210 and a display module 250 for a display system 200. The interface board provides an interface to receive different formats for video signals, such as functional blocks 120-128 from FIG. 1.

In the embodiment in FIG. 2, the interface board 210 includes an ADC 220, a transition minimized differential signaling (TMDS) receiver 230 as is well known in the art, and a video decoder 240 as well as a scalar 245 coupled with ADC 220, TMDS receiver 230, and video decoder 240. ADC 220 may receive analog RGB data as well as horizontal synch and vertical synch signals on input 218 and output digital data, synch information, and a clock signal (collectively output 222) to scalar 245. In an embodiment, a controller, such as controller 150, may include the scalar 245, as described above in reference to FIG. 1.

As shown in the present embodiment, receiver 230 may receive TMDS data over multiple transmit lines and a clock input, represented collectively as input 228, and may output digital data, synch information, and a clock signal 222 to scalar 245.

The video decoder 240 may receive a composite signal 238 and output digital data, synch signals, and at least one clock signal (collectively output 240) to scalar 245.

The interface board 210 may receive data in various formats at ADC 220, TMDS receiver 230, and video decoder 240, but is not limited to these receivers. Other embodiments may include any receiver circuitry for video signals to provide to a display module 250.

In the present example, scalar 245 outputs data 247, clock signal 248, and horizontal and vertical synch signals 249 to timing controller (TCON) 260 on display module 250. In an embodiment, scalar 245 may output LVDS signals to timing controller 260. TCON 260 typically resides in panel 160, but may reside elsewhere, for example in controller 150 from FIG. 1.

In the present embodiment, LVDS data may include RGB color data and control data. Scalar 245 may be used to scale an image based on a panel size or resolution. For example, if scalar 245 outputs to a television with 425 lines of horizontal resolution for a scan line it will scale an image differently than if the scalar outputs to a panel operating at an XGA resolution with 1024 horizontal pixels of resolution.

Referring to the FIG. 2, timing controller 260 is coupled with a memory 252 and a crystal block 254. The memory 252 may be used to store any functions of the timing controller 260, for example, the memory 252 may store color LUTs and load them into the timing controller 260 at start up. In one embodiment the memory 252 may be an electrically erasable programmable read only memory (EEPROM), but any non-volatile memory may be suitable for the present embodiment and volatile memory may be suited for some embodiments. The crystal 254 times operations of the timing controller 210.

An example display module 250 may be a TFT module to drive a TFT LCD 290, but any other display may be used. The display 250 may include a timing controller 260 coupled to a column driver 270 and a row driver 280. The column and row drivers 270 and 280 drive the transistor sources (columns) and gates (rows), respectively, of the TFT LCD 290.

Timing controller 260 receives data, a clock signal, and synch signals from scalar 245 and outputs control signals 266 to row driver 280 and control signal 264 and data signal 262 to column driver 270. Column driver 270 and row driver 280 collectively control the TFT LCD 290 to display an image.

In an embodiment, the timing controller 260 may output reduced swing differential signaling (RSDS) data to the column driver 270. RSDS is a derivative of the Low Voltage Differential Signal (LVDS) technology often used in flat panel display (FPD) chipsets that is well known in the art. Other embodiments may use signaling formats other than RSDS. The column driver 270 is adapted to drive transistor sources of the TFT LCD 290. Likewise, the row driver 280 is adapted to drive transistor gates of the TFT LCD 290.

Figure 3:
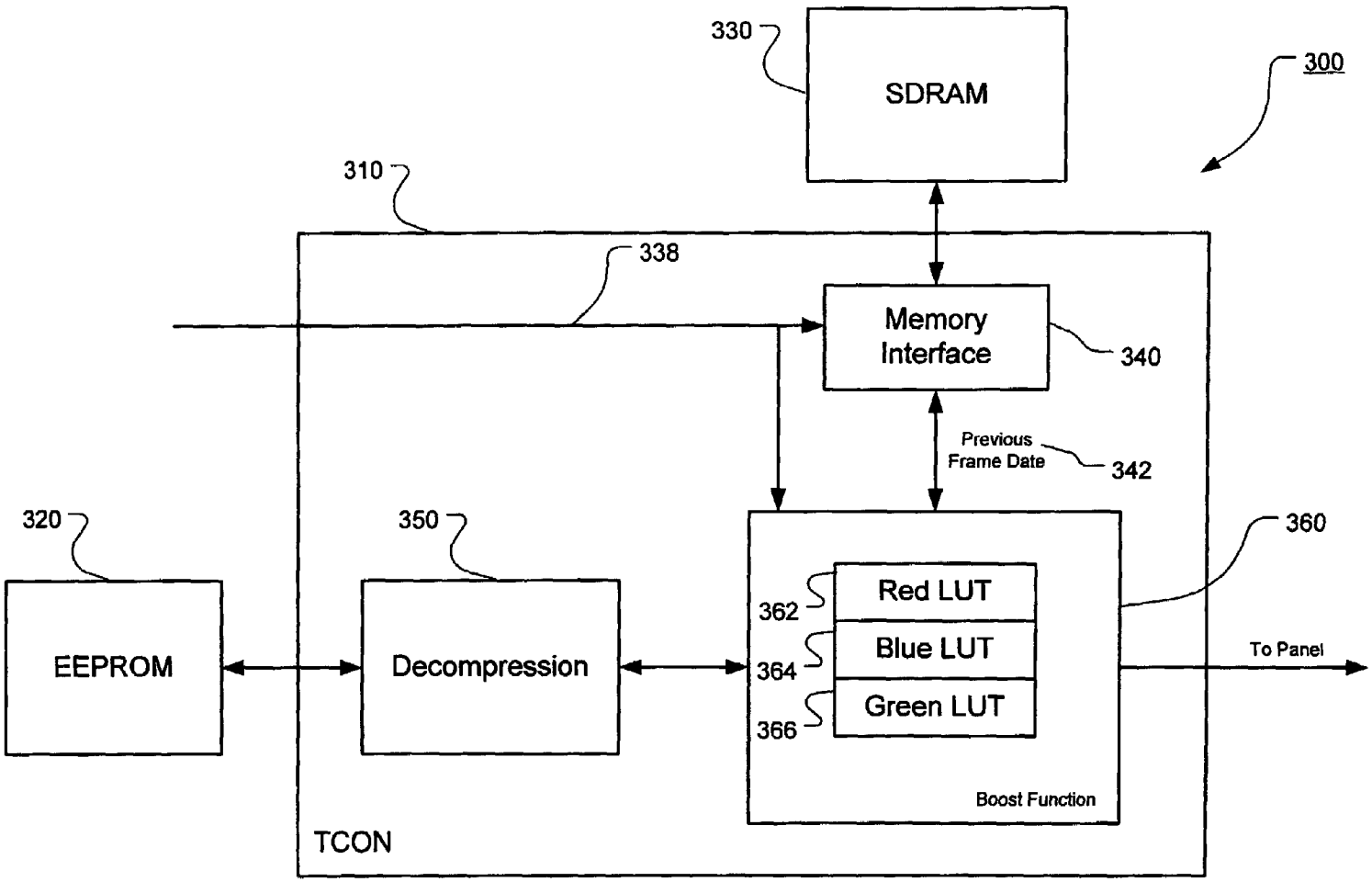
FIG. 3 is a block diagram of timing and control circuitry for a display system.

FIG. 3 is a block diagram of a TCON 310 for a display system 300. TCON 310 may be used for TCON 260, but other aspects of TCON 310 are illustrated and certain features are omitted for ease of illustration. Referring to FIG. 3, Timing controller 310 is shown coupled with external memories EEPROM 320 and synchronous dynamic random access memory (SDRAM) 330. Similar to memory 252 in FIG. 2, EEPROM 320 may be used to store any functions of the timing controller 310, for example, the EEPROM 320 may store color LUTs 362, 364 and 366, and load them into the timing controller 310 at start up.

In the present example, timing controller 310 includes a video input 338 that may provide current frame data to memory interface 340 and a boost function 360 that includes a red LUT 362, a blue LUT 364 and a green LUT 366. Memory interface 340 may provide previous frame data 342 to the boost function 360. Memory interface 340 may also be coupled with a memory such as SDRAM 330 and SDRAM 330 may be used as a frame buffer to store image frames. Boost function 360 is coupled with decompression block 350 which is coupled with EEPROM 320. Boost function 360 may provide video data to a display panel.

The embodiment is shown with EEPROM 320 memory, but any non-volatile memory may be suitable for the present embodiment and volatile memory may be suited for some embodiments. The embodiment in FIG. 3 also is illustrated with SDRAM 330, but any suitable memory may be used.

An embodiment apparatus may comprise a TCON 310 for a display system 100, a first look up table 362 containing data for the TCON 310 to operate the display system 100, and a second look up table 364 with data that is offset from the first look up table 362 data to preserve memory space in the TCON 310. An embodiment may further comprise an electrically erasable memory 320 coupled with the TCON 310, the electrically erasable memory 320 to store an offset look up table to be loaded in the TCON 310. An embodiment may also comprise a third look up table 366 with data that is offset from at least one of the first and second look up tables 362 and 364, respectively. In an embodiment, the look up tables may contain color data, but need not be so limited.

An embodiment may be a system 200 comprising a display device 290, a column driver 270 and a row driver 280 coupled with the display device 290, and control circuitry such as TCON 260 coupled with the column driver 270 and the row driver 280, the control circuitry comprising a first look up table 362 and at least one offset look up table, the control circuitry to send data and control information to the column driver 270 and control the display device 290 with the first look up table 362 and the at least one offset look up table. Another embodiment may also comprise an electrically erasable memory 320 coupled with the controller, the electrically erasable memory 320 to store an offset look up table to be loaded in the controller. In an embodiment, the look up tables may contain color data, but need not be so limited.

FIG. 4 illustrates a LUT that may be used in an embodiment. In an embodiment a LUT may represent previous frame data by column and current frame data by row. The respective frame data may represent color information or may represent correction values for other variations such as temperature, etc. FIG. 4 illustrates an example embodiment for a red color LUT such as red LUT 362 in timing controller 310 of FIG. 3. LUTs may be used to store values for downstream processing, for example LUTs may be used to map a luminance value to a color, or to more directly store voltage levels for drivers for a display, etc. LUTs provide data that is processed in a TCON 260 to further enhance an image, and is currently output as 6/8/10 bit values for each pixel on a display such as TFT LCD 290. It would be obvious to one of ordinary skill in the art to translate these output bit values to voltage levels to drive different pixels in a display.

In this example, if the previous frame data is 96 and the current frame data is 64, the LUT provides a value of 46 that may be sent to column driver 270 and converted into a drive voltage for TFT LCD 290 in FIG. 2. Likewise, if a previous frame data is 80 and a current frame data is 128, the LUT in FIG. 4 provides a value of 152.

FIG. 5 illustrates a second LUT that may be used in an embodiment. The present embodiment only changes two entries from the LUT in FIG. 4, but this is to simplify the example, in practice any entry may change values. In an embodiment a LUT may represent previous frame data by column and current frame data by row. The respective frame data may represent color information or may represent correction values for other variations such as temperature, etc. FIG. 5 illustrates an example embodiment for a blue color LUT such as blue LUT 364 in timing controller 310 of FIG. 3.

In this example, if the previous frame data is 96 and the current frame data is 64, the LUT provides a value of 68 that may be sent to column driver 270 and converted into a drive voltage for TFT LCD 290 in FIG. 2. Likewise, if a previous frame data is 80 and a current frame data is 128, the LUT in FIG. 5 provides a value of 145.

FIG. 6 illustrates an offset LUT that may be used in an embodiment. In an offset LUT the values may represent an offset from another LUT. For example, the only values that differ between the LUTs in FIGS. 4 and 5 correspond to the previous frame data 96 and the current frame data 64, and previous frame data 80 and a current frame data 128. Since no other values change they may be represented as a 0 offset from the LUT in FIG. 4. For values that change between LUTs, an offset LUT may represent the change from a reference LUT (FIG. 4) to another LUT (FIG. 5) instead of values themselves. Doing so, simplifies the offset LUT and speeds its operation.

In an embodiment, the offset (or compressed) LUT has 255 entries but instead of 8 bits being required to represent each entry, it can represent each entry with a much smaller number and thus save LUT or memory space, for example in memory space such as EEPROM 320 or even in memory internal to TCON 310. In an embodiment, the number of bits for each entry/each row/each column of a LUT could be different or the same. Embodiments allow flexibility for different implementations and compression ratio targets.

Referring to the present example, the subject red LUT 362 entry from FIG. 4 is 46 while the corresponding blue LUT 364 entry is 68. Since the difference between 68 and 46 is 22, the offset can be represented by 10110 in binary which requires only 5 bits. Instead of storing a 68 in the LUT or memory, the present approach can store 010110, where the 5 LSBs indicate the difference (grey level) of 22. In an embodiment, the MSB can be used as a sign bit to represent +22. In this example, the second entry is a reference plus an offset, in particular, 46 plus the offset 22 is equal to 68 as represented in the respective entry of FIG. 5.

Referring to the second present example, red LUT 362 entry is 152 and the blue LUT 364 entry is 145. Similar to the previous example, an offset may be used and the blue LUT 364 entry would be 1111 (4 bits) which equates to −7.

In example embodiments the difference between each entry of a reference LUT and the corresponding entry of offset LUTs, will average to less than 4 bits achieving a compression ratio of higher than 50 percent, but may even result in no offset which would allow the minimum values to be stored in LUTs or memory and therefore provide maximum compression.

Figure 7:
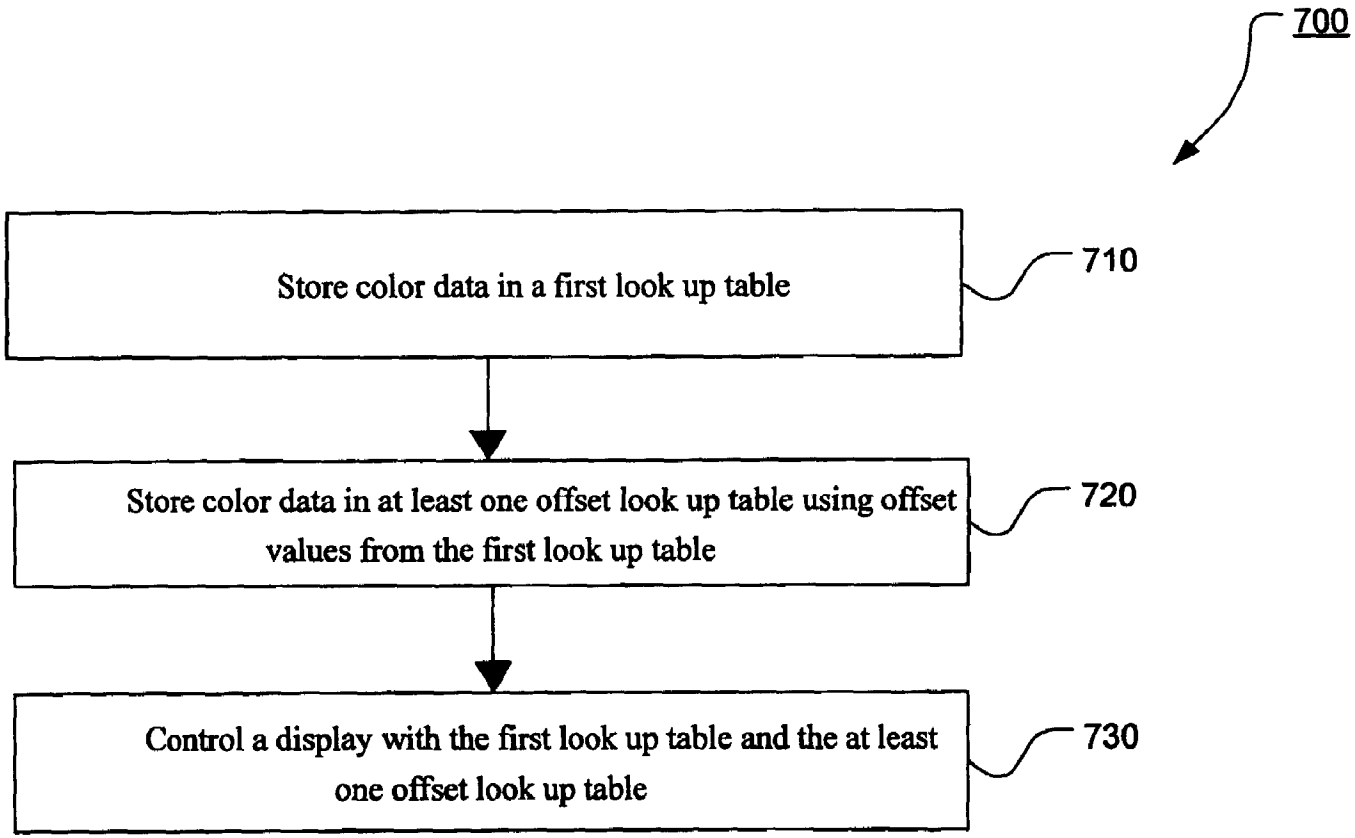
FIG. 7 is a flow diagram representing an embodiment method.

FIG. 7 is a flow diagram representing an embodiment method boost LUT compression method. Referring to FIG. 7, and embodiment method may comprise storing color data in a first look up table in block 710, storing color data in at least one offset look up table using offset values from the first look up table as illustrated in block 720, and controlling a display with the first look up table and the at least one offset look up table in block 730.

An embodiment may further comprise loading the look up tables into a controller from an electrically erasable memory. An embodiment may comprise saving memory space in a controller by using the offset look up table. Another embodiment may comprise saving memory space in the electrically erasable memory by using the offset look up table.

An embodiment may be an apparatus comprising means for storing color data in a first look up table, means for storing color data in at least one offset look up table, the at least one offset look up table using offset values from the first look up table, and means for controlling a display with the first look up table and the at least one offset look up table. Another embodiment may also comprise means for loading the look up tables into a controller from an electrically erasable memory. An embodiment may also comprise means for saving memory space in a controller by using the offset look up table. An alternate embodiment may also comprise means for saving memory space in the electrically erasable memory by using the offset look up table.

The present invention may be embodied in other specific forms without departing from its spirit or essential characteristics. The described embodiments are to be considered in all respects only as illustrative instead of restrictive or limiting. Therefore, the scope of the invention is indicated by the appended claims rather than by the foregoing description. All changes, modifications, and alterations that come within the meaning, spirit, and range of equivalency of the claims are to be embraced as being within the scope of the appended claims.

The invention claimed is:

1. An apparatus comprising:

a controller for a display system;

a first look up table containing data for the controller to operate the display system, the first look up table representing previous frame data by column and current frame data by row, wherein first entries in the first look up table are each represented by a first number of bits; and a second look up table with data that is offset from the first look up table data to preserve memory space in the controller, the second look up table representing previous frame data by column and current frame data by row, wherein second entries in the second look up table are each represented by a second number of bits, wherein the second entries are offset values from the first entries, and wherein the second number of bits is less than the first number of bits.

2. The apparatus of claim 1, comprising an electrically erasable memory coupled with the controller, the electrically erasable memory to store an offset look up table to be loaded in the controller.

3. The apparatus of claim 1, comprising a third look up table with data that is offset from at least one of the first and second look up tables.

4. The apparatus of claim 1, wherein the look up tables contain color data.

5. The apparatus of claim 1, wherein:

the first look up table comprises first color values;

the second look up table comprises first offset values; and the controller is configured to generate second color values by offsetting the first color values using the first offset values and to generate output image data using the first color values and the second color values.

6. The apparatus of claim 5, further comprising a third look up table comprising second offset values, wherein the controller is further configured to generate third color values by offsetting at least one of the first color values and the second color values using the second offset values and to generate output image data using the first color values, the second color values, and the third color values.

7. The apparatus of claim 1, wherein the first look up table comprises reference values and the second look up table comprises correction values as offsets to the reference values.

8. The apparatus of claim 7, wherein the correction values comprise temperature correction values.

9. A method comprising:

storing color data in a first look up table;

storing color data in at least one offset look up table, the at least one offset look up table using offset values from the first look up table; and controlling a display with the first look up table and the at least one offset look up table.

10. The method of claim 9, comprising loading the look up tables into a controller from an electrically erasable memory.

11. The method of claim 9, comprising saving memory space in a controller by using the offset look up table.

12. The method of claim 10, comprising saving memory space in the electrically erasable memory by using the offset look up table.

13. The method of claim 9, wherein storing color data in the at least one offset look up table comprises storing the offset values and wherein controlling the display comprises:

retrieving first color data from the first look up table;

generating second color data by offsetting the first color data using the offset values; and generating output image data using the first color data and the second color data.

14. A system comprising:

a display device;

a column driver and a row driver coupled with the display device; and control circuitry coupled with the column driver and the row driver, the control circuitry comprising a first look up table and at least one offset look up table, the control circuitry to send data and control information to the column driver and control the display device with the first look up table and the at least one offset look up table, wherein the first look up table represents previous frame data by column and current frame data by row and first entries in the first look up table are each represented by a first number of bits, wherein the offset look up table represents previous frame data by column and current frame data by row, wherein second entries in the offset look up table are each represented by a second number of bits, wherein the second entries are offset values from the first entries, and wherein the second number of bits is less than the first number of bits.

15. The system of claim 14, comprising an electrically erasable memory coupled with the controller, the electrically erasable memory to store an offset look up table to be loaded in the controller.

16. The system of claim 14, wherein the look up tables contain color data.

17. An apparatus comprising:

means for storing color data in a first look up table;

means for storing color data in at least one offset look up table, the at least one offset look up table using offset values from the first look up table; and means for controlling a display with the first look up table and the at least one offset look up table.

18. The apparatus of claim 17, comprising means for loading the look up tables into a controller from an electrically erasable memory.

19. The apparatus of claim 17, comprising means for saving memory space in a controller by using the offset look up table.

20. The apparatus of claim 17, comprising means for saving memory space in the electrically erasable memory by using the offset look up table.

* * * * *